US007509061B2

(12) United States Patent
Takiguchi

(10) Patent No.: US 7,509,061 B2
(45) Date of Patent: Mar. 24, 2009

(54) IMAGE FORMING APPARATUS

(75) Inventor: Toshiki Takiguchi, Nara (JP)

(73) Assignee: Sharp Kabushiki Kaisha, Osaka (JP)

( * ) Notice: Subject to any disclaimer, the term of this patent is extended or adjusted under 35 U.S.C. 154(b) by 424 days.

(21) Appl. No.: 11/210,963

(22) Filed: Aug. 25, 2005

(65) Prior Publication Data

US 2006/0045548 A1 Mar. 2, 2006

(30) Foreign Application Priority Data

Aug. 27, 2004 (JP) ..... 2004-248772

(51) Int. Cl.
*G03G 15/00* (2006.01)

(52) U.S. Cl. ..... 399/21; 399/22

(58) Field of Classification Search ..... 271/193; 399/361–407; 100/100
See application file for complete search history.

(56) References Cited

U.S. PATENT DOCUMENTS 5,121,170 A * 6/1992 Bannai et al. ..... 399/303
2004/0114945 A1* 6/2004 Takagi ..... 399/21

FOREIGN PATENT DOCUMENTS

JP 06040600 A * 2/1994
JP 6-186810 A 7/1994
JP 2002311469 * 10/2002
JP 2002-372816 A 12/2002
JP 2003-307981 A 10/2003

OTHER PUBLICATIONS

Machine translation of JP 405246573A.*

* cited by examiner

*Primary Examiner*—Daniel J Colilla
*Assistant Examiner*—Allister Primo
(74) *Attorney, Agent, or Firm*—Birch, Stewart, Kolasch & Birch, LLP

(57) ABSTRACT

A sheet P on which an image of a developer is unfixed is recovered from a transfer unit 6 to a sheet recovery portion 64, the sheet P is bent with the surface of the sheet P on which the image of the developer has been transferred facing inward and, while remaining bent, the sheet P drops downward between an outer guide plate 72 and a transfer convey belt 51, then an openable cover 74 is opened to remove the sheet P.

11 Claims, 5 Drawing Sheets

IMAGE FORMING APPARATUS

BACKGROUND OF THE INVENTION

This application claims priority under 35 U.S.C. § 119(a) on Patent Application No. 2004-248772 filed in Japan on Aug. 27, 2004, the entire contents of which are hereby incorporated by reference.

The present invention relates to electrophotographic image forming apparatuses such as copying machines, facsimile machines, and printers.

In this type of image forming apparatus, an image is formed on a surface of a sheet while the sheet is being conveyed, and if an abnormality such as a jam occurs during the conveying of the sheet, the conveying of the sheet is stopped and an operation is conveyed out to solve the jam or other abnormality. Ordinarily, the conveying of the sheet is stopped at the same time as the abnormality occurs, or the conveying of the sheet is stopped after the sheet is conveyed to a location where the sheet can be removed from the image forming apparatus easily.

For example, a technique is disclosed in JP 2003-307981A in which, when an abnormality such as a jam occurs, the sheet is conveyed to a position between a transfer belt and a fixing device, after which the conveying of the sheet is stopped, thereby making it easy to remove the sheet from the transfer belt.

Furthermore, a technique is disclosed in JP H06-186810A in which, although the conveying of the sheet is stopped when an abnormality such as a jam occurs, manual conveying of the sheet to the fixing device is enabled so that the image on the surface of the sheet can be fixed.

In this regard, sometimes an abnormality such as a jam may occur to a sheet on which an image of a developer has been transferred such that the conveying of the sheet is stopped prior to the sheet being conveyed to the fixing device. In this case, when the sheet is removed from the image forming apparatus, the image of the developer on the surface of the sheet is not fixed, and therefore problems have occurred such as the developer on the surface of the sheet spattering and smearing the surrounding area, or the user's hand becoming soiled.

Alternatively, a portion of the sheet may be in a state of insertion with respect to the fixing device when the conveying of the sheet is stopped. In this case, a problem is caused in that the developer on the surface of the sheet smears the fixing device. Fixing devices commonly sandwich the sheet between a heating roller and a pressure roller, and fix the image of the developer to the surface of the sheet by applying heat and pressure to the image of the developer on the surface of the sheet. When the conveying of the sheet is stopped in a state in which a portion of the sheet is inserted into the fixing device and the sheet is sandwiched between the heating roller and the pressure roller, the developer on the surface of the sheet sometimes becomes thermally fused such that the developer adheres to the heating roller or the pressure roller, leading to smearing and abrasions on the surface of the rollers, and the rollers may become damaged. Moreover, when the conveying of sheets recommences after the jam or other abnormality has been cleared, smearing on the rollers may be transferred to a sheet that is newly conveyed in.

SUMMARY OF THE INVENTION

The present invention has been devised in consideration of these issues, and it is an object thereof to provide an image forming apparatus in which, even if an abnormality such as a jam occurs and the conveying of a sheet is stopped, the developer on the surface of the sheet does not spatter and smear surrounding areas and neither the user's hand nor the fixing device becomes soiled.

In order to achieve the above-mentioned object, an image forming apparatus according to the present invention forms an image on a surface of a sheet while the sheet is being conveyed, and causes conveying of the sheet to stop when an abnormality occurs during the conveying of the sheet, wherein the conveying of the sheet is stopped after the sheet has been bent into a state in which the surface of the sheet on which the image is formed is facing inward.

With this configuration, the outer side of the bent sheet can be held by hand when removing the sheet from the image forming apparatus so that the hand of the user does not become soiled. The sheet can then be folded in two by hand while the front surface of the sheet is facing inward, thereby enabling the prevention of spattering of the developer on the surface of the sheet.

Furthermore, the present invention may be configured so as to be provided with a first convey path in which an image is formed on the surface of a sheet while the sheet is being conveyed, and a second convey path in which the sheet is bent and the conveying of the sheet is stopped, wherein the conveying of the sheet is switched from the first convey path to the second convey path when an abnormality occurs during the conveying of the sheet.

With this configuration, the developer on the surface of the sheet does not smear the first convey path when an abnormality occurs. Furthermore, by setting the first convey path to pass through the fixing device and the second convey path to bypass the fixing device, the sheet will bypass the fixing device by switching from the first convey path to the second convey path when an abnormality such as a jam occurs, and therefore the developer on the surface of the sheet does not soil the fixing device.

In the above configuration, it is preferable that, in the second convey path, only a leading edge of the sheet is stopped while the sheet is conveyed and the sheet yields so that the surface of the sheet on which the image is formed faces inward, further bending the sheet, after which the sheet is stopped.

With this configuration, the sheet can be folded substantially in two.

Furthermore, the present invention may be configured so as to be provided with a sheet conveying means for conveying a sheet, wherein by changing a direction in which the sheet is conveyed by the sheet conveying means, the conveying of the sheet is switched from the first convey path to the second convey path.

In this configuration, the sheet conveying means may rotate an endless belt to convey a sheet on the endless belt and a direction in which the sheet is conveyed by the sheet conveying means may be changed by displacing the endless belt.

With this configuration, it is possible to switch from the first convey path to the second convey path while the sheet continues to be conveyed by the sheet conveying means or the endless belt.

In the above configuration, it is preferable that, a switching means is provided for switching an area of the endless belt between a grounded state and an ungrounded state in a location at which the sheet is caused to separate from the endless belt and be sent off, wherein the area of the endless belt is grounded by the switching means when the sheet is to be conveyed on the endless belt using electrostatic adhesion with the sheet being conveyed on the first convey path, and the area of the endless belt is made ungrounded by the switching means when the sheet is to be conveyed on the second convey path.

With this configuration the charge is discharged at a grounding point at an area of the endless belt such that the electrostatic adhesion applied to the sheet at that area is weakened and the sheet can be made to separate easily from the endless belt. Moreover, the area on the endless belt is made ungrounded by the switching means when the sheet is conveyed on the second convey path. Thus, the power of the electrostatic adhesion on the sheet continues to be maintained at this area and the sheet can be conveyed reliably along the second convey path by the endless belt.

DESCRIPTION OF THE PREFERRED EMBODIMENTS

Hereinafter, embodiments of the present invention will be described in detail with reference to the accompanying drawings.

Figure 1:
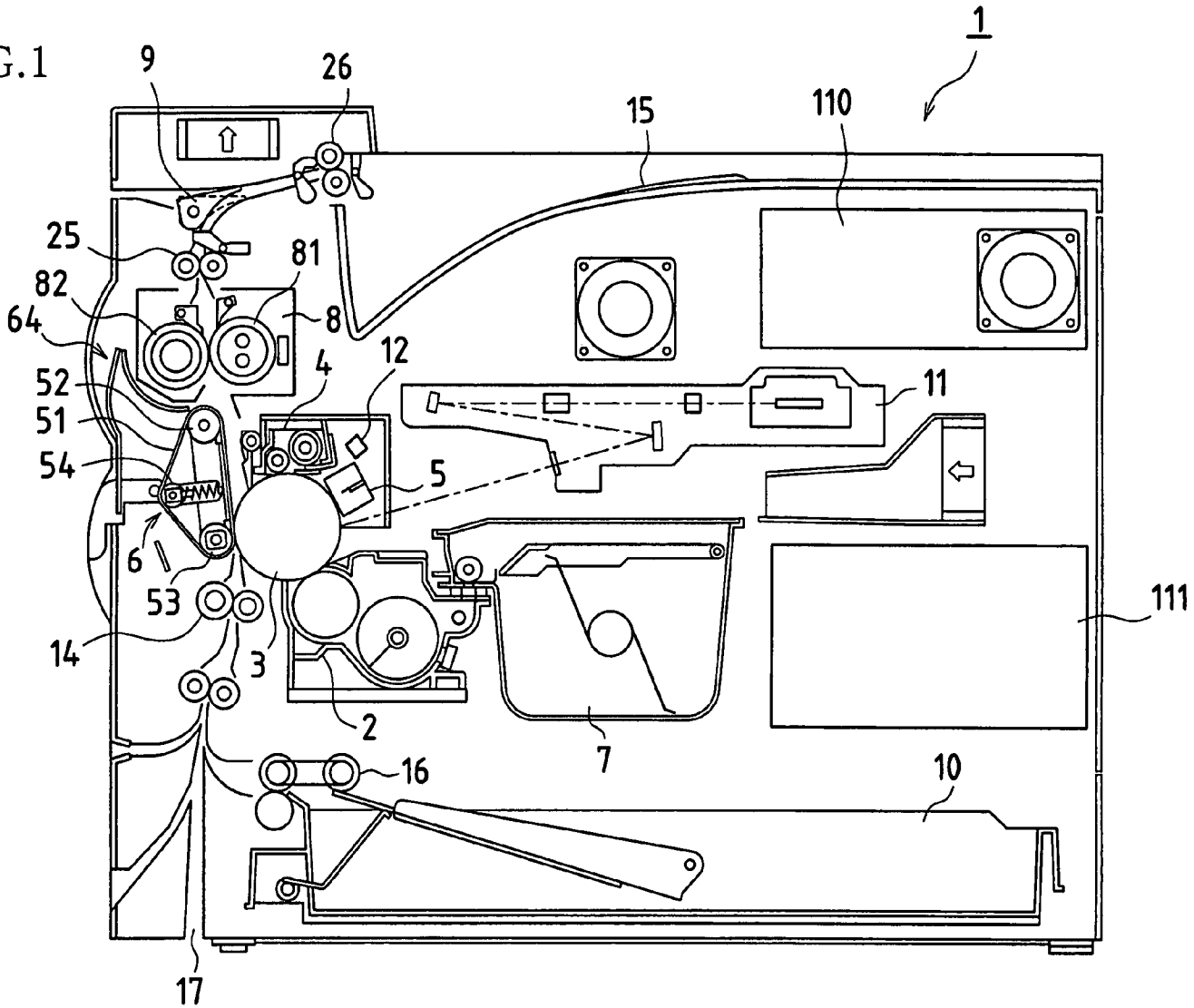
FIG. 1 is a lateral view showing an example of an image forming apparatus according to the present invention.

FIG. 1 is a lateral view showing an example of an image forming apparatus according to the present invention. The image forming apparatus 1 records and outputs images that have been read in by an image reading device (an unshown, integrated unit) or, as images, data received from a device (an image processing device such as a personal computer for example) that is externally connected to the image forming apparatus 1.

In the image forming apparatus 1, various processing units that convey out respective functions for image formation are arranged centered around a photosensitive drum 3, and an image-forming portion is constituted by these processing units. Namely, the image-forming portion is provided around the photosensitive drum 3 and is constituted by units including a charging unit 5, an optical scanning unit 11, a development unit 2, a transfer unit 6, a cleaning unit 4, and an electricity removal lamp 12, arranged in order.

The charging unit 5 uniformly charges the surface of the photosensitive drum 3. The optical scanning unit 11 scans an optical image onto the uniformly charged photosensitive drum 3 to write an electrostatic latent image. The development unit 2 uses a developer supplied from a development supply container 7 to turn the electrostatic latent image formed on the photosensitive drum 3 into a manifest image. The transfer unit 6 transfers the manifest image of the developer formed on the photosensitive drum 3 to a sheet. The cleaning unit 4 removes any developer that is residual on the photosensitive drum 3, thereby enabling a new image to be recorded on the photosensitive drum 3. The electricity removal lamp 12 removes electric charges from the surface of photosensitive drum 3.

A supply tray 10 is arranged built into the image forming apparatus 1 main unit at a lower area of the image forming apparatus 1.

The supply tray 10 is a recording material storage tray that stores sheets. The sheets stored in the supply tray 10 are separated one by one by a pickup roller 16 or the like and conveyed to a register roller 14. The sheets are then progressively supplied to between the transfer unit 6 and the photosensitive drum 3 with a timing regulated by the register roller 14 in line with the process of transferring an image on the photosensitive drum 3. After this, the image of the developer on the photosensitive drum 3 is transferred to the sheet. It should be noted that resupplying sheets to the supply tray 10 is conveyed out by pulling out the supply tray 10 from the front side (operation side) of the image forming apparatus 1.

Provided at a lower part of the image forming apparatus 1 are an unshown device that is prepared as a peripheral device having multi-level sheet supply trays and a sheet inlet 17 for receiving sheets sent by a device such as a large capacity recording material supply device capable of storing a large volume of sheets and supplying sheets in order toward the image-forming portion.

A fixing device 8 is arranged at an upper area within the image forming apparatus 1. The fixing device 8 receives in order the sheets on which images are transferred and fixes the image of the developers transferred on sheets using heat and pressure from components such as a fixing roller 81 and a pressure roller 82. In this way, the image of the developers are fixed onto the sheets.

A sheet on which an image has been fixed is conveyed further upward by convey rollers 25, then pass through a switching gate 9 to be discharged to a stacking tray 15 by inversion rollers 26.

Arranged in the empty areas above and below the optical scanning unit 11 are a control portion 110 that accommodates components such as a circuit board for controlling image formation processing and an interface board that receives image data from external devices, as well as a power source device 111 for supplying power to such components as the above-mentioned various types of interface boards and units for conveying out image formation.

Figure 2:
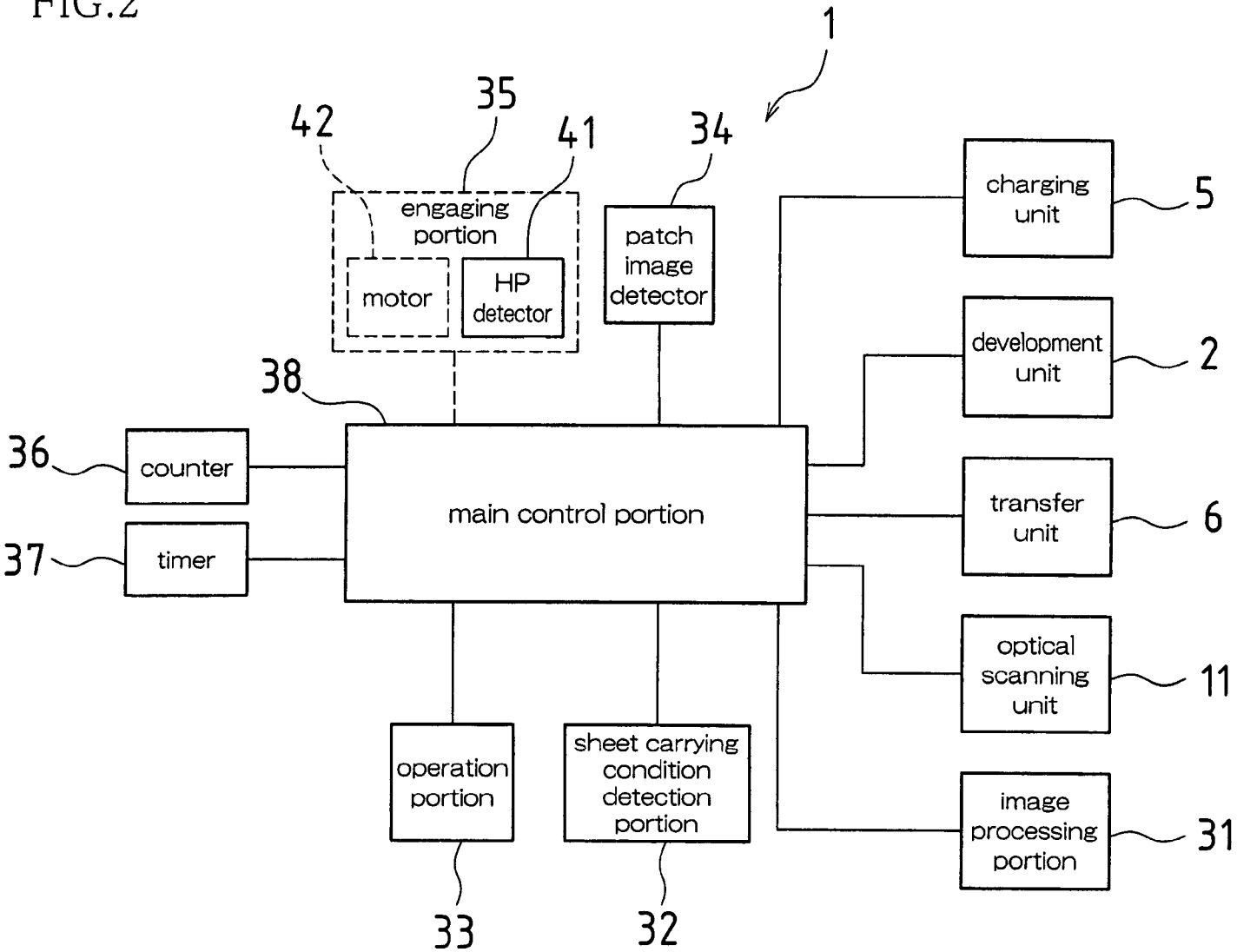
FIG. 2 is a block diagram showing the structure of the image forming apparatus of FIG. 1.

FIG. 2 is a block diagram showing the structure of the image forming apparatus 1. In addition to the above-mentioned charging unit 5, the optical scanning unit 11, the development unit 2, and the transfer unit 6, the image forming apparatus 1 is provided with components such as an image processing portion 31, a sheet conveying condition detection portion 32, an operation portion 33, a patch image detector 34, an engaging portion 35, a counter 36, a timer 37, and a main control portion 38.

The image processing portion 31 processes image data. Image data processes conducted by the image processing portion 31 include shading correction, darkness correction, area separation, filtering, MTF correction, resolution conversion, electronic zoom (magnifying), and gamma correction.

The sheet conveying condition detection portion 32 includes a plurality of sheet detectors arranged along the sheet convey path from the supply tray 10 to the register roller 14, then between the transfer unit 6 and the photosensitive drum 3 to the fixing device 8, and to the stacking tray 15. It uses these sheet detectors to detect sheet blockages (jams) that occur while the sheet is being conveyed.

The operation portion 33 fulfils such roles as detecting input from an operation panel constituted by a touch panel or operation keys, and controlling the display on a liquid crystal display portion of the operation panel.

The patch image detector 34 is for detecting darkness adjustment patches formed on the photosensitive drum 3.

The engaging portion 35 is for controlling the movement of the transfer unit 6, and is provided with an HP detector 41 that detects whether or not the transfer unit 6 is at a home position and a stepping motor 42 for moving the transfer unit 6.

The main control portion 38 is for providing comprehensive control of the image forming apparatus 1, controlling such units as the charging unit 5, the optical scanning unit 11, the development unit 2, the transfer unit 6, the image processing portion 31, and the engaging portion 35, for example.

Next, the transfer unit 6 is described in detail with reference to the lateral view of FIG. 3.

The transfer unit 6 is structured such that a transfer convey belt 51 is provided in a tensioned state around a drive roller 52, a transfer electrode roller 53, and a tension roller 54. The transfer unit 6 conveys sheets by using electrostatic adhesion to adhere sheets to the transfer convey belt 51.

The drive roller 52, the transfer electrode roller 53, and the tension roller 54 are pivotably supported on a support frame 55. Furthermore, a flat plate portion 55*a* of one end of the support frame 55 is bent and a pair of protruding portions 55*b* are provided on the flat plate portion 55*a* facing the ends of the shaft of the tension roller 54, with the protruding portions 55*b* respectively coupled to end portions of coiled springs 56 and protruding into the coiled springs 56. Each of the coiled springs 56 applies a leftward biasing force to the shaft ends of the tension roller 54 with a load of 1.2 kg (total 2.4 kg), thereby applying tension through the tension roller 54 to the transfer convey belt 51. In regard to the flat plate portion 55*a* of the support frame 55, its width is substantially equivalent to the transfer convey belt 51 and it guides the transfer convey belt 51 while keeping it level.

The drive roller 52 is rotationally driven in the direction of arrow A by a motor (not shown in drawings), thereby rotationally driving the transfer convey belt 51 so that a sheet P is conveyed by the transfer convey belt 51 in the region from the transfer electrode roller 53 to the drive roller 52. The movement speed of the transfer convey belt 51 matches the peripheral speed of the photosensitive drum 3.

Furthermore, the drive roller 52 is made grounded and ungrounded via a switch 65. The switching of the switch 65 is controlled by the main control portion 38.

The support frame 55 is linked to an oscillation frame 57 via the shaft of the drive roller 52, and the support frame 55 is axially supported to be rotatable with respect to the oscillation frame 57 around the axle of the drive roller 52. Furthermore, a flat plate portion 57*a* at one end of the oscillation frame 57 is bent, and a pair of coiled springs 58 abutting the shaft ends of the transfer electrode roller 53 protrude from the flat plate portion 57*a*. Each of the coiled springs 58 applies a rightward biasing force to the shaft ends of the transfer electrode roller 53 with a load of 0.5 to 1.5 kg (total 1.0 to 3.0 kg). In this way, the support frame 55 applies a counterclockwise biasing force around the axle of the drive roller 52 and the transfer electrode roller 53 presses the photosensitive drum 3 through the transfer convey belt 51. That is, when the sheet P is being conveyed between the transfer unit 6 and the photosensitive drum 3, the transfer electrode roller 53 presses the photosensitive drum 3 through the transfer convey belt 51 and the sheet P.

The oscillation frame 57 is pivotably supported with respect to the main unit of the image forming apparatus 1 by an axle 59. Furthermore, a coiled spring 61 abutting the flat plate portion 57*a* of the oscillation frame 57 is provided protruding on the main unit side of the image forming apparatus 1. The coiled spring 61 applies a biasing force to the oscillation frame 57 with a load of approximately 6 kg. In this way, the oscillation frame 57 constantly applies a biasing force clockwise around the axle 59, and the lower area of the flat plate portion 57*a* of the oscillation frame 57 presses against a cam 62.

When the cam 62 rotates, the lower area of the flat plate portion 57*a* of the oscillation frame 57 is displaced so that the oscillation frame 57 rotationally moves around the axle 59 thus changing the orientation of a convey region S from the transfer electrode roller 53 to the drive roller 52 on which the sheet P is conveyed by the transfer convey belt 51.

The cam 62 is driven to rotate by the stepping motor 42 of the engaging portion 35 and the drive of the stepping motor 42 is controlled by the main control portion 38 shown in FIG. 2. Based on the detection output of the HP detector 41 of the engaging portion 35, the main control portion 38 controls the drive of the stepping motor 42 so as to control the rotational angle of the cam 62. That is, the stepping motor 42 undergoes drive control and the rotational angle of the cam 62 is set to the rotational angle shown in FIG. 3 so that the HP detector 41 can detect whether or not the transfer unit 6 is at the home position. Here the position of the transfer unit 6 is set as shown by the dotted line in FIG. 4 and the convey region S of the sheet P on the transfer convey belt 51 from the transfer electrode roller 53 to the drive roller 52 faces between the fixing roller 81 and the pressure roller 82 of the fixing device 8 such that the sheet P is conveyed in a straight line by the transfer convey belt 51 to between the fixing roller 81 and the pressure roller 82. Hereinafter, the straight convey path from between the transfer electrode roller 53 and the photosensitive drum 3 to between the fixing roller 81 and the pressure roller 82 of the fixing device 8 as shown by the dotted line in FIG. 4 is referred to as a first convey path.

Furthermore, the main control portion 38 causes the cam 62 to rotate by 180° by causing the stepping motor 42 to rotate by a fixed number of rotational steps. At this time, the position of the transfer unit 6 is set as shown by the solid line in FIG. 4 and the convey region S of the sheet P on the transfer convey belt 51 faces a sheet recovery portion 64 such that the sheet P is conveyed by the transfer convey belt 51 to the sheet recovery portion 64. Hereinafter, the curved convey path from between the transfer electrode roller 53 and the photosensitive drum 3 to the final convey position of the sheet P inside the sheet recovery portion 64 as shown by the solid line in FIG. 4 is referred to as a second convey path.

It should be noted that the oscillation frame 57 may be caused to rotate back and forth around the axle 59 using a component such as an actuator combining a solenoid and a plunger instead of the cam 62 and the stepping motor 42.

Here, the transfer convey belt 51 is formed as an endless component by extrusion molding or centrifugal molding or the like with urethane or NBR (acrylic nitrile butadiene rubber) as a principle material. Furthermore, the transfer convey belt 51 is a conductive component with a thickness of approximately 0.5 mm to 0.65 mm and has a volume resistivity value in the range of $10^8$ to $10^{10}$ Ωcm. Further still, the surface of the transfer convey belt 51 has been given a fluorine coating.

The transfer electrode roller 53 has a core of a stainless steel or ferrous rod material and a conductive foam elastic layer is provided around this core, formed having an outer diameter of approximately 18 mm. The conductive elastic layer is a material such as urethane or EPDM (ethylene-propylene-diene-monomer copolymer rubber), has a volume resistivity value of approximately $10^7$ Ωcm, and a hardness in the range of 45 to 60 in JIS-C (ASCA-C). It should be noted that the conductive elastic layer of the transfer electrode roller 53 is not limited to one layer but may be multiple layers.

Furthermore, a transfer bias voltage of a reverse polarity to the charging polarity of the toner is applied in the transfer electrode roller 53 by a high voltage power source 63 (in the present embodiment, the transfer bias voltage has a positive polarity since the toner is negatively charged), and this transfer bias voltage is applied to the core of the transfer electrode roller 53 from the high voltage power source 63 via the coiled springs 58. The high voltage power source 63 is driven to have a constant current so that an electric current in the range of 20 to 40 μA flows from internal control circuits. Because of this constant current driving, the voltage applied to the transfer electrode roller 53 varies in the range of 500 V to 4 KV according to the material of the sheet P and environmental conditions.

The tension roller 54 is a metal roller made of stainless steel. It should be noted that when increasing the size of the transfer unit 6, a tension roller of a larger outer diameter may be implemented by using aluminum-based materials.

Since rubber-based materials having a large friction coefficient are used for the transfer electrode roller 53, a rubber roller or the like is not particularly used for the drive roller 52, and by using metal-based stainless steel or aluminum roller, the outer diameter precision of the drive roller 52 can be increased while suppressing the shaking thereof, thus improving the conveying performance of the transfer convey belt 51.

Ordinarily, as described above, the sheet P is conveyed along the convey path from the supply tray 10 to the register roller 14, then between the transfer unit 6 and the photosensitive drum 3 to the fixing device 8, and to the stacking tray 15, and during the conveying thereof, an image of a developer is transferred onto the sheet P and the image of the developer on the sheet P is fixed.

Figure 3:
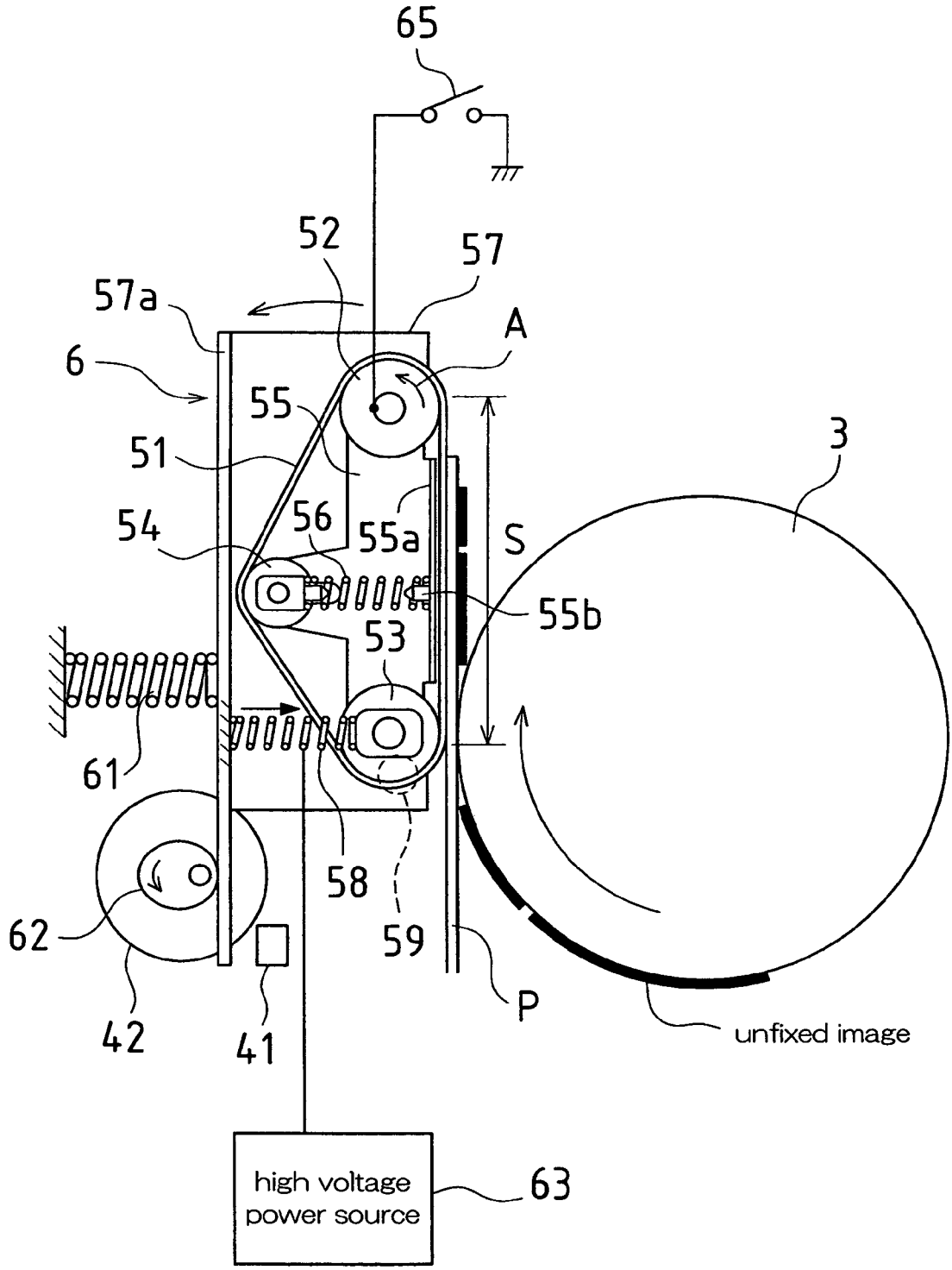
FIG. 3 is a lateral view showing an enlarged view of a vicinity of a transfer unit in the image forming apparatus of FIG. 1.
Figure 4:
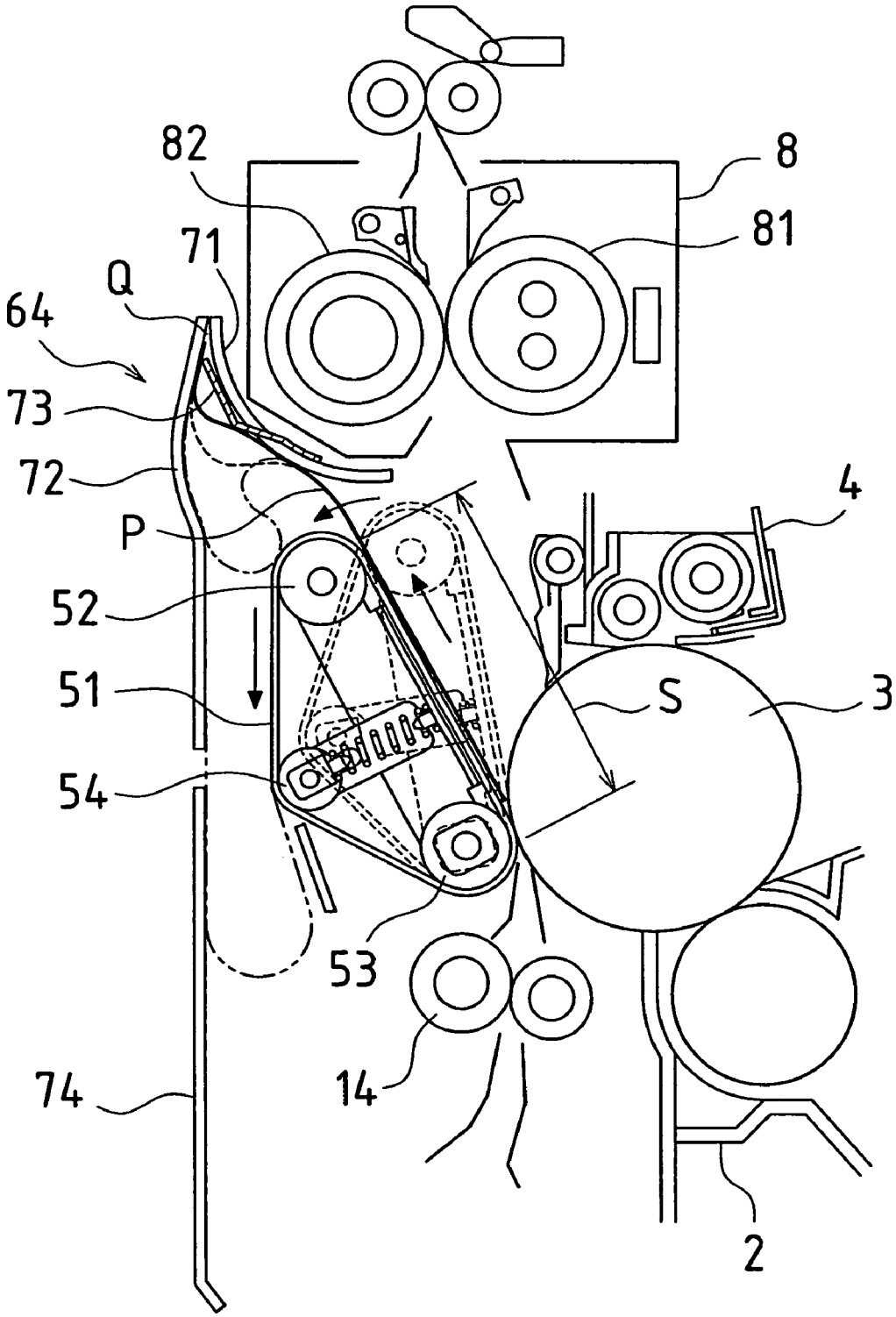
FIG. 4 is a lateral view showing an operation of the transfer unit of FIG. 3.

At this time, the main control portion 38 sets the rotational angle of the cam 62 to the rotational angle shown in FIG. 3 so that the HP detector 41 can detect whether or not the transfer unit 6 is at the home position. Accordingly, the position of the transfer unit 6 is set as shown by the dotted line in FIG. 4 such that the first convey path is formed, and the sheet P is conveyed between the fixing roller 81 and the pressure roller 82 by the transfer convey belt 51.

Furthermore, the main control portion 38 turns on the switch 65 so that the drive roller 52 is grounded via the switch 65. In this way, the electric charge of the portion of the transfer convey belt 51 in the vicinity of the periphery of the drive roller 52 is discharged. Thus, in the vicinity of the drive roller 52, the sheet P rapidly separates from the transfer convey belt 51 and the sheet P is conveyed between the fixing roller 81 and the pressure roller 82.

On the other hand, a sheet P being conveyed in this way sometimes becomes blocked. When this happens, the sheet conveying condition detection portion 32 detects a sheet blockage using at least one of the sheet detectors arranged along the convey path of the sheet P and sends notification of this to the main control portion 38. In response to this, the main control portion 38 stops operations involved in the conveying of the sheet P then displays on the liquid crystal display portion of the operation panel that a jam has occurred and the location of that occurrence. In this way, the user can be made aware of the occurrence of the jam and the location of that occurrence, and is able to remove the blocked sheet or the sheet on which an image was being formed.

However, although the image of the developer was being transferred to a sheet that was being passed between the transfer unit 6 and the photosensitive drum 3, the image of the developer has not been fixed on the sheet by the fixing device 8, and therefore when a user does not take care in attempting to remove this sheet, the developer on the sheet may spatter and smear the surrounding area and soil the hand of the user.

Accordingly, in the present embodiment, a sheet on which the image of the developer is unfixed is recovered from the transfer unit 6 to the sheet recovery portion 64, thus preventing the spattering and smearing of the developer on the sheet.

Next, the processing procedure for recovering a sheet on which the image of the developer is unfixed is described in detail.

First, when a sheet blockage is detected by the sheet conveying condition detection portion 32, the main control portion 38 drives the stepping motor 42 to rotate so as to rotate the cam 62 by 180°, thus setting the position of the transfer unit 6 as shown by the solid line in FIG. 4. This turns the convey region S of the sheet P by the transfer convey belt 51 toward the sheet recovery portion 64, thereby forming the second convey path, and the sheet P is conveyed by the transfer convey belt 51 to the sheet recovery portion 64.

Furthermore, the main control portion 38 turns off the switch 65 so that the drive roller 52 becomes ungrounded. In this way, the electric charge of the portion of the transfer convey belt 51 in the vicinity of the periphery of the drive roller 52 is not discharged and this portion is in a charged state, so that the sheet P can be conveyed by being reliably adhered to the transfer convey belt 51 using electrostatic adhesion. Thus, the sheet P can be reliably conveyed to the sheet recovery portion 64 even though the convey path from between the transfer electrode roller 53 and the photosensitive drum 3 to the sheet recovery portion 64 via the convey region S on which the sheet P is conveyed by the transfer convey belt 51 is curved.

The sheet recovery portion 64 has an inner guide plate 71, an outer guide plate 72, a correcting protrusion portion 73, and an openable cover 74. When the sheet P is being conveyed to the sheet recovery portion 64 by the transfer convey belt 51, the leading edge of the sheet P contacts the inner wall of the inner guide plate 71 and slides up and, moreover, the leading edge of the sheet P contacts the inner wall of the outer guide plate 72 and slides up, so that the leading edge of the sheet P is inserted and held in a gap Q between the upper end of the inner guide plate 71 and the upper end of the outer guide plate 72. When this happens, the surface of the sheet P on which the image of the developer has been transferred contacts the correcting protrusion portion 73 in the region from the drive roller 52 to the gap Q such that this surface of the sheet P yields inward.

In this state, when the sheet P continues to be conveyed by the transfer convey belt 51, since the leading edge of the sheet P is held by the gap Q, the sheet P bends with its front surface inward as shown by the dashed dotted line in FIG. 4.

Figure 5:
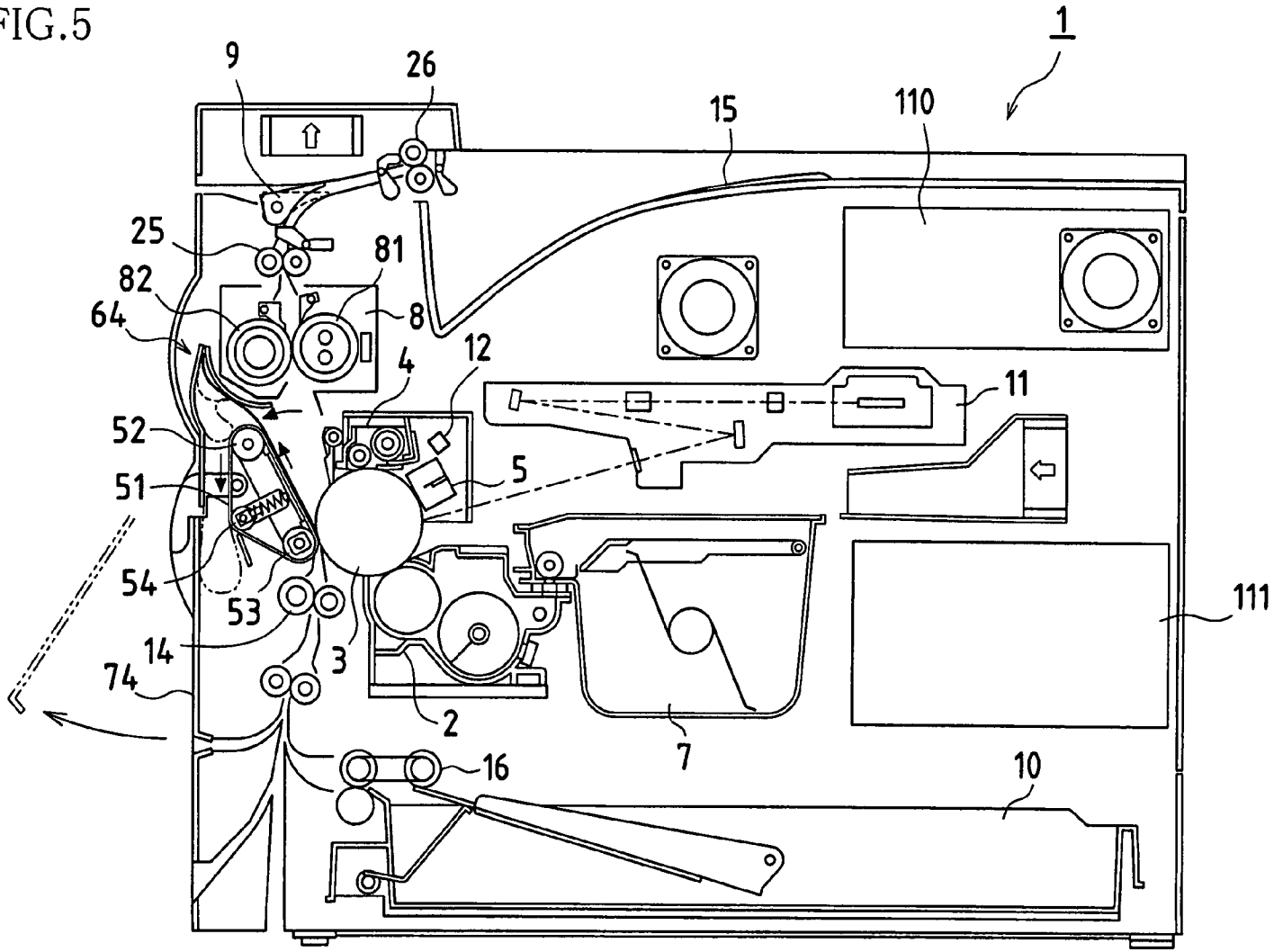
FIG. 5 is a lateral view showing an operation of the transfer unit in the image forming apparatus of FIG. 1.

Further still, when the sheet P continues to be conveyed by the transfer convey belt 51, the leading edge of the sheet P comes away from the gap Q as shown by the dashed double-dotted line in FIG. 4 and the sheet P is conveyed by the transfer convey belt 51 while in this bent form, such the bent sheet P drops downward between the outer guide plate 72 and the transfer convey belt 51 as shown by the dashed double-dotted line in FIG. 5.

During the time required for the sheet P to be conveyed to the sheet recovery portion 64 and drop downward between the outer guide plate 72 and the transfer convey belt 51, the sheet P continues to be conveyed by the transfer convey belt 51. After this, the main control portion 38 stops the transfer convey belt 51, controls the driving of the stepping motor 42 to cause the cam 62 to rotate so that the HP detector 41 can detect whether or not the transfer unit 6 is at the home position. Furthermore, the main control portion 38 turns on the switch 65 so that the drive roller 52 becomes grounded.

Thus, once the bent sheet P drops downward between the outer guide plate 72 and the transfer convey belt 51 as shown by the dashed double-dotted line in FIG. 5, the openable cover 74 can be opened to remove the sheet P. At this time, the outer side of the bent sheet P can be held by hand such that the hand of the user does not become soiled. The sheet P can then be folded in two by hand while the front surface of the sheet P is facing inward, thereby enabling the prevention of spattering of the developer on the surface of the sheet P.

In this way, in the present embodiment, a sheet on which the image of the developer is unfixed is recovered from the transfer unit 6 to the sheet recovery portion 64, and the sheet P is bent with the surface of the sheet P on which the image of the developer is transferred facing inward, and therefore there is no soiling of the user's hand and no spattering of developer from the surface of the sheet P when the sheet P is removed.

Furthermore, since the sheet bypasses the fixing device 8 by switching from the first convey path to the second convey path, the developer on the surface of the sheet does not smear the first convey path or the fixing device 8.

It should be noted that the image forming apparatus according to the present invention is not limited to the above-described example, but includes other various variations. For example, instead of a transfer convey belt, it can be applied to a convey belt that simply has the function of conveying sheets.

Furthermore, the image forming apparatus of the present invention can be applied not only to printers but also to devices such as copying machines and facsimile machines.

The present invention can be embodied and practiced in other different forms without departing from the spirit and essential characteristics thereof. Therefore, the above-described embodiments are considered in all respects as illustrative and not restrictive. The scope of the invention is indicated by the appended claims rather than by the foregoing description. All variations and modifications falling within the equivalency range of the appended claims are intended to be embraced therein.

What is claimed is:

1. An image forming apparatus that forms an image on a surface of a sheet while the sheet is being conveyed, and causes conveying of the sheet to stop when an abnormality occurs during the conveying of the sheet, comprising:

a first convey path in which an image is formed on the surface of a sheet while the sheet is being conveyed, and a second convey path in which the sheet is bent and the conveying of the sheet is stopped, wherein the conveying of the sheet is switched from the first convey path to the second convey pat when an abnormality occurs during the conveying of the sheet, and wherein the conveying of the sheet is stopped after the sheet has been bent into a state in which the surface of the sheet on which the image is formed is facing inward and the image formed on the sheet is an unfixed image.

2. The image forming apparatus according to claim 1, wherein in the second convey path, only a leading edge of the sheet is stopped while the sheet is conveyed and the sheet yields so that the surface of the sheet on which the image is formed faces inward, further bending the sheet, after which the sheet is stopped.

3. The image forming apparatus according to claim 1, comprising:

a sheet conveying means for conveying a sheet, wherein by changing a direction in which the sheet is conveyed by the sheet conveying means, the conveying of the sheet is switched from the first convey path to the second convey path.

4. The image forming apparatus according to claim 3, wherein the sheet conveying means rotates an endless belt to convey a sheet on the endless belt and a direction in which the sheet is conveyed by the sheet conveying means is changed by displacing the endless belt.

5. The image forming apparatus according to claim 4, comprising:

a switching means for switching an area of the endless belt between a grounded state and an ungrounded state in a location at which the sheet is caused to separate from the endless belt and be sent off, wherein the area of the endless belt is grounded by the switching means when the sheet is to be conveyed on the endless belt using electrostatic adhesion with the sheet being conveyed on the first convey path, and the area of the endless belt is made ungrounded by the switching means when the sheet is to be conveyed on the second convey path.

6. An image forming apparatus that forms an image on a surface of a sheet while the sheet is being conveyed, and causes conveying of the sheet to stop when an abnormality occurs during the conveying of the sheet, comprising:

a sheet conveying unit for conveying a sheet, a sheet conveying condition detection portion for detecting a sheet blockage, a sheet recovery portion for stopping conveying of the sheet after the sheet has been bent into a state in which the surface of the sheet on which the image is formed is facing inward, and a first convey path in which the image is formed on the surface of a sheet while the sheet is being conveyed, and a second convey path in which the sheet is bent and the conveying of the sheet is stopped, wherein the conveying of the sheet is switched by the sheet recovery portion from the first convey path to the second convey path when an abnormality occurs during the conveying of the sheet and the image formed on the sheet is an unfixed image.

7. The image forming apparatus according to claim 6, wherein in the second convey path, only a leading edge of the sheet is stopped by the sheet recovery portion while the sheet is conveyed and the sheet yields so that the surface of the sheet on which the image is formed faces inward, further bending the sheet, after which the sheet is stopped.

8. The image forming apparatus according to claim 6, wherein by changing a direction in which the sheet is conveyed by the sheet conveying unit, the conveying of the sheet is switched from the first convey path to the second convey path.

9. The image forming apparatus according to claim 8, wherein the sheet conveying unit rotates an endless belt to convey a sheet on the endless belt and a direction in which the sheet is conveyed by the sheet conveying unit is changed by displacing the endless belt.

10. The image forming apparatus according to claim 9, comprising:

a switching means for switching an area of the endless belt between a grounded state and an ungrounded state in a location at which the sheet is caused to separate from the endless belt and be sent off, wherein the area of the endless belt is grounded by the switching means when the sheet is to be conveyed on the endless belt using electrostatic adhesion with the sheet being conveyed on the first convey path, and the area of the endless belt is made ungrounded by the switching means when the sheet is to be conveyed on the second convey path.

11. An image forming apparatus that forms an image on a surface of a sheet while the sheet is being carried, and causes carrying of the sheet to stop when an abnormality occurs during the carrying of a sheet, comprising:

a first convey path in which an image is formed on the surface of a sheet while the sheet is being conveyed, and a second convey path in which the sheet is bent and the conveying of the sheet is stopped, said image forming apparatus comprising a sheet recovery portion for recovering a sheet on which an image is unfixed, with a surface of the sheet on which the image is formed being facing inward, wherein the conveying of the sheet is switched from the first convey path to the second convey path when an abnormality occurs during the conveying of the sheet wherein the carrying of the sheet is stopped after the sheet has been bent at the sheet recovery portion and the image formed on the sheet is an unfixed image.

* * * * *